US011191300B2

(12) United States Patent
Minzoni

(10) Patent No.: US 11,191,300 B2
(45) Date of Patent: Dec. 7, 2021

(54) AEROSOL-GENERATING ARTICLE AND METHOD FOR MANUFACTURING AEROSOL-GENERATING ARTICLES

(71) Applicant: PHILIP MORRIS PRODUCTS S.A., Neuchatel (CH)

(72) Inventor: Mirko Minzoni, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 15/736,047

(22) PCT Filed: Jun. 22, 2016

(86) PCT No.: PCT/EP2016/064363
§ 371 (c)(1),
(2) Date: Dec. 13, 2017

(87) PCT Pub. No.: WO2016/207192
PCT Pub. Date: Dec. 29, 2016

(65) Prior Publication Data

US 2018/0177235 A1 Jun. 28, 2018

(30) Foreign Application Priority Data

Jun. 23, 2015 (EP) ..... 15173224

(51) Int. Cl.
*A24F 7/04* (2006.01)
*A24C 5/01* (2020.01)
(Continued)

(52) U.S. Cl.
CPC ..... *A24F 7/04* (2013.01); *A24C 5/01* (2020.01); *A24D 1/20* (2020.01); *A24D 3/17* (2020.01); *A24C 5/474* (2013.01); *A24C 5/476* (2013.01)

(58) Field of Classification Search
CPC . A24F 47/008; A24F 7/04; A24D 1/14; A24C 5/474; A24C 5/476
See application file for complete search history.

(56) References Cited

U.S. PATENT DOCUMENTS 25,803 A * 10/1859 Bryant ..... A24F 1/26 131/181
2,039,298 A * 5/1936 Davidson ..... A24D 3/04 131/361

(Continued)

FOREIGN PATENT DOCUMENTS

CN 202750702 U 2/2013
UA 12402 A 2/1997

(Continued)

OTHER PUBLICATIONS

PCT/EP2016/064363 International Search Report and Written Opinion dated Sep. 20, 2016 (12 pages).

(Continued)

*Primary Examiner* — Francisco W Tschen
*Assistant Examiner* — Guy F Mongelli
(74) *Attorney, Agent, or Firm* — Mueting Raasch Group

(57) ABSTRACT

The aerosol-generating article (1) comprises a tobacco element and a mouthpiece element. The tobacco element comprises an aerosol-forming substrate (2), a support element (3) arranged downstream of the aerosol-forming substrate (2) and an aerosol-cooling element (4) arranged downstream of the support element. The mouthpiece element comprises a filter segment (5) and a hollow tube (6). The aerosol-cooling element (4) has a length of at most 15 millimeter. A length of the mouthpiece element is adapted according to the length of the aerosol-cooling element (4) such that a total length of the aerosol-generating article (1) is kept at a (Continued)

predefined total length. The invention also relates to a method for manufacturing aerosol-generating articles.

16 Claims, 2 Drawing Sheets

(51) Int. Cl.
*A24D 1/20* (2020.01)
*A24D 3/17* (2020.01)
*A24C 5/47* (2006.01)

(56) References Cited

U.S. PATENT DOCUMENTS 2,912,987 A * 11/1959 Molins ..... A24C 5/52 131/94
3,067,644 A * 12/1962 Dearsley ..... A24C 5/478 83/402
4,582,071 A * 4/1986 Westcott ..... A24D 3/043 131/336
4,924,883 A * 5/1990 Perfetti ..... A24D 1/22 131/336
5,046,514 A * 9/1991 Bolt ..... D21H 17/71 131/359
5,060,676 A * 10/1991 Hearn ..... A24B 15/165 131/369
10,813,381 B2 * 10/2020 Klipfel ..... A24B 15/14
2007/0074733 A1 * 4/2007 Rasouli ..... A24D 3/14 131/231
2007/0235050 A1 * 10/2007 Li ..... A24D 3/043 131/338
2008/0092912 A1 * 4/2008 Robinson ..... A24B 13/02 131/200
2010/0024834 A1 * 2/2010 Oglesby ..... A61M 11/041 131/194
2011/0126848 A1 * 6/2011 Zuber ..... A24F 40/46 131/329
2011/0192408 A1 * 8/2011 Inagaki ..... A24F 40/46 131/194
2012/0067360 A1 * 3/2012 Conner ..... A24B 15/165 131/280
2012/0298123 A1 * 11/2012 Woodcock ..... A24D 1/22 131/328
2014/0261482 A1 * 9/2014 Fall ..... A24B 15/42 131/297
2014/0305448 A1 * 10/2014 Zuber ..... A24D 1/20 131/328
2014/0326259 A1 * 11/2014 Tritz ..... A24D 3/061 131/276
2014/0326260 A1 * 11/2014 Gladden ..... A24D 1/22 131/329
2014/0338680 A1 * 11/2014 Abramov ..... A24F 47/008 131/328
2015/0013697 A1 * 1/2015 Mironov ..... A24F 47/008 131/328
2015/0027454 A1 * 1/2015 Li ..... A61M 11/044 131/328
2015/0027458 A1 * 1/2015 Grant ..... A24F 7/04 131/328
2015/0027474 A1 * 1/2015 Zuber ..... A24F 42/10 131/329
2015/0027475 A1 * 1/2015 Jarriault ..... A24D 3/048 131/329
2015/0053219 A1 * 2/2015 Roudier ..... A24F 47/008 131/329
2015/0128968 A1 * 5/2015 Chapman ..... A24F 47/008 131/329
2015/0157052 A1 * 6/2015 Ademe ..... A24D 1/22 131/58
2015/0166916 A1 * 6/2015 Malgat ..... C08K 5/098 131/330
2015/0208727 A1 * 7/2015 Kuczaj ..... H05B 1/0225 219/492
2015/0296874 A1 * 10/2015 Awty ..... A24B 15/283 131/337
2015/0359264 A1 * 12/2015 Fernando ..... H01J 49/0036 131/328
2016/0044963 A1 * 2/2016 Saleem ..... H05B 3/0014 131/328
2016/0205996 A1 * 7/2016 John ..... A24D 1/02
2016/0227839 A1 * 8/2016 Zuber ..... A24F 47/004

FOREIGN PATENT DOCUMENTS

WO WO 2012/164009 12/2012
WO WO 2013/098405 7/2013
WO WO 2013/120854 8/2013
WO WO 2013/190036 12/2013
WO WO 2014/023557 2/2014
WO WO 2014/158051 10/2014
WO WO 2015/082649 6/2015
WO WO 2015/082651 6/2015
WO WO-2015082649 A1 * 6/2015 ..... A24F 40/465
WO WO 2016/207192 12/2016

OTHER PUBLICATIONS

Office Action issued in China for Application No. 201680030880.4 dated Jan. 22, 2020 (18 pages). English translation included.
Office Action issued in Japan for Application No. 2017-562265 dated Aug. 17, 2020 (3 pages).
Office Action issued in India for Application No. 201817002287 dated Jun. 8, 2020 (6 pages). English translation included.
Office Action issued in Ukraine for Application No. 2017 11543 dated Sep. 8, 2021 (14 pages). English translation included.

* cited by examiner

AEROSOL-GENERATING ARTICLE AND METHOD FOR MANUFACTURING AEROSOL-GENERATING ARTICLES

This application is a U.S. National Stage Application of International Application No. PCT/EP2016/064363, filed Jun. 22, 2016, which was published in English on Dec. 29, 2016, as International Publication No. WO 2016/207192 A1. International Application No. PCT/EP2016/064363 claims priority to European Application No. 15173224.5 filed Jun. 23, 2015.

The invention relates to aerosol-generating articles and a method for manufacturing aerosol-generating articles. In particular, the invention relates to aerosol-generating articles for use in electronic heating devices.

Various aerosol-generating articles for use in electronic heating devices are known. They comprise a plurality of segments including an aerosol-forming substrate and a mouthpiece. Further segments may be aerosol treating segments, for example, for altering aerosol characteristics.

Aerosol-generating articles are mass products. Minimal cost reduction in the manufacture of a single article may have a large effect on overall production cost.

Therefore, it would be desirable to have a cost reduced aerosol-generating article and a method for manufacturing such cost reduced aerosol-generating articles. In particular, it would be desirable to have a cost reduced aerosol-generating article usable in conventionally available electronic heating devices.

According to an aspect of the present invention, there is provided an aerosol-generating article. The aerosol-generating article comprises a tobacco element and a mouthpiece element. The tobacco element comprises an aerosol-forming substrate, a support element arranged downstream of the aerosol-forming substrate and an aerosol-cooling element arranged downstream of the support element. The mouthpiece element comprises a filter segment and a hollow tube. Preferably, the hollow tube is arranged downstream of the filter segment. The aerosol-cooling element of the tobacco element has a length of at most 15 millimeter. However, a length of the mouthpiece element is adapted according to the length of the aerosol-cooling element, such that a total length of the aerosol-generating article is kept at a predefined total length.

Commonly available electronic heating devices are designed for use of aerosol-generating articles of predefined dimensions, in particular of a predefined standard length. In order for aerosol-generating articles to be usable with these standard heating devices, a total length of an aerosol-generating article should have a standard length. Typically, such a standard length is 45 millimeter. In addition, dimensions and arrangement of an aerosol-forming substrate comprised in the aerosol-generating article, which substrate is heated by a heating element of the heating device, is preferably kept unchanged.

Some of the materials used in aerosol-generating articles are more cost relevant than others. For example, the materials used for an aerosol-cooling element, in particular crimped polylactic acid sheets, are costly. Thus, in the aerosol-generating article according to the present invention, the length of the aerosol-cooling element is reduced compared to such an element in a standard aerosol-generating article for electronic devices. Typically, a standard length of an aerosol-cooling element is 18 millimeter. In order to maintain a total length of the aerosol-generating article at a predefined length, for example at 45 millimeter, the length of the mouthpiece element is extended to make up for the shorter aerosol-cooling element.

It has been surprising to find that the aerosol-cooling element may be shortened to a certain extent without negatively affecting smoke chemistry. It has also been surprising to find that if the length difference is compensated in the mouthpiece, this may be done without altering a transfer of smoke constituents though the mouthpiece. In particular, no alteration of smoke constituents by the mouthpiece have been detected if a hollow tube is used for total length compensation. A shortening of the aerosol-cooling element by only a few millimeter has shown to lead to significant cost reduction. Preferably, an extension of the mouthpiece is realized by the provision of a hollow tube. A hollow tube, for example a cardboard tube, may be manufactured at very low cost, such that cost savings may be achieved with a partial "replacement" of the aerosol-cooling element in the tobacco part of the aerosol-generating article by a hollow tube in the mouthpiece part of the aerosol-generating article.

Thus, an aerosol-cooling element having a desired (non-standard) length of maximal 15 millimeter may be chosen according to a desired application of the aerosol-cooling element. An article comprising said aerosol-cooling element having a length shorter than a standard element would also have a corresponding shorter total length. In order now to avoid a different total length of the article, the length of the mouthpiece, preferably the length of the hollow tube comprised in the mouthpiece, is adapted accordingly. The length of the mouthpiece or the length of the hollow tube, respectively, is adapted such that the total length of the article is kept at a predefined total length. Preferably, the predefined total length is a standard length.

As used herein, by 'length' is meant the maximum longitudinal dimension between the distal end and the proximal end of elements or segments or portions of elements or segments, of the aerosol-generating article.

The aerosol-generating article comprises two ends: a proximal end through which aerosol exits the aerosol-generating article and is delivered to a user and a distal end opposite the proximal end. In use, a user may draw on the proximal end.

The proximal end may also be referred to as the mouth end or the downstream end and is downstream of the distal end. The distal end may also be referred to as the upstream end and is upstream of the proximal end.

As used herein, the terms 'upstream' and 'downstream' are used to describe the relative positions of elements or segments, or portions of elements or segments, of the aerosol-generating article in relation to the direction in which a user draws on the aerosol-generating article during use thereof.

The tobacco element is arranged upstream of the mouthpiece element. The tobacco element includes the distal end of the aerosol-generating article. The mouthpiece element includes the proximal end of the aerosol-generating article.

A mouthpiece element is the last portion in the downstream direction of the aerosol-generating article. A consumer contacts the mouthpiece element in order to pass an aerosol generated by the aerosol-generating article though the mouthpiece element to the consumer. Thus, a mouthpiece element is arranged downstream of an aerosol-forming substrate. A mouthpiece element may comprise at least one filter segment. A filter segment may have low particulate filtration efficiency or very low particulate filtration efficiency. A filter segment may be longitudinally spaced apart from the aerosol-forming substrate. A filter segment may be a cellulose acetate filter plug made of cellulose acetate tow.

The mouthpiece element may also comprise a hollow tube. A filter segment may be located at the downstream end of the aerosol-generating article.

Preferably, the hollow tube, if present, is arranged at the downstream end of the mouthpiece element and thus at the downstream end of the aerosol-generating article. By this, the effect of a recessed filter is given to the aerosol-generating article. Thus, with the aerosol-generating article according to the invention a haptic sensation may be offered to customers when using an electronic smoking system, which haptic sensation is equal to the one they may be used to from smoking conventional cigarettes provided with recessed filters.

A hollow tube of a mouthpiece element may be made of cardboard. The hollow tube may also be made of different material, for example paper or thin plastics sheet material. Preferably, the hollow tube has a stability that allows for handling the aerosol-generating article. In particular, the hollow tube is preferably made of a material that withstands insertion action of the aerosol-generating article into a heating device. Such insertion action may include a pushing force required to push a heating element, for example a heating blade, into the aerosol-forming substrate at the distal end of the aerosol-generating article.

The mouthpiece element may have an external diameter of between 5 millimeter and 10 millimeter, for example of between 6 millimeter and 8 millimeter. In a preferred embodiment, the mouthpiece element has an external diameter of 7.2 millimeter plus or minus 10 percent. The mouthpiece element may have a length of between 8 millimeter and 25 millimeter, preferably a length of between 10 millimeter and 17 millimeter. In a preferred embodiment, the mouthpiece element has a length of approximately 12 millimeter.

As a general rule, whenever a value is mentioned throughout this application, this is to be understood such that the value is explicitly disclosed. However, a value is also to be understood as not having to be exactly the particular value due to technical considerations. A value may, for example, include a range of values corresponding to the exact value plus or minus 20 percent.

As used herein, the term 'aerosol-cooling element' is used to describe an element having a large surface area and a low resistance to draw. In use, an aerosol formed by volatile compounds released from the aerosol-forming substrate is drawn through the aerosol-cooling element before being transported to the mouth end of the aerosol-generating article. In contrast to high resistance-to-draw filters, for example filters formed from bundles of fibers, and other mouthpiece segments, aerosol-cooling elements have a low resistance to draw. Chambers and cavities within an aerosol-generating article such as expansion chambers and support elements are also not considered to be aerosol cooling elements.

An aerosol-cooling element preferably has a porosity in a longitudinal direction of greater than 50 percent. The airflow path through the aerosol-cooling element is preferably relatively uninhibited. An aerosol-cooling element may be a gathered sheet or a crimped and gathered sheet. An aerosol-cooling element may comprise a sheet material selected from the group consisting of polyethylene (PE), polypropylene (PP), polyvinylchloride (PVC), polyethylene terephthalate (PET), polylactic acid (PLA), cellulose acetate (CA), and aluminium foil or any combination thereof. An aerosol-cooling element preferably comprises a sheet of PLA, more preferably a crimped, gathered sheet of PLA. An aerosol-cooling element may be formed from a sheet having a thickness of between 10 micrometer and 250 micrometer, for example 50 micrometer. An aerosol-cooling element may be formed from a gathered sheet having a width of between 150 millimeter and 250 millimeter. An aerosol-cooling element may have a specific surface area of between 300 millimeter$^2$ per millimeter length and 1000 millimeter$^2$ per millimeter length between 10 millimeter$^2$ per mg weight and 100 millimeter$^2$ per mg weight. In some embodiments, the aerosol-cooling element may be formed from a gathered sheet of material having a specific surface area of about 35 millimeter$^2$ per mg weight. An aerosol-cooling element may have an external diameter of between 5 millimeter and 10 millimeter, for example 7 millimeter.

As the aerosol passes through the aerosol-cooling element, the temperature of the aerosol is reduced due to transfer of thermal energy to the aerosol-cooling element. Furthermore, water droplets may condense out of the aerosol and adsorb to the material of the aerosol-cooling element. Depending on the type of material forming the aerosol-cooling element, a water content of the aerosol may be reduced from anywhere between 0 percent and 90 percent. For example, when the aerosol-cooling element is comprised of polylactic acid, the water content is not considerably reduced. For example, when starch based material, for example such as Mater-Bi, is used to form the aerosol-cooling element, a water reduction may be approximately 40 percent. Accordingly, through selection of the material comprising the aerosol-cooling element, the water content in the aerosol may be chosen.

Aerosol formed by heating for example a tobacco-based aerosol-forming substrate, will typically comprise phenolic compounds. An aerosol-cooling element may reduce levels of phenol and cresols by 90 percent to 95 percent.

Experiments have shown that a desired aerosol cooling or reduction in phenolic compounds may be achieved also in aerosol-cooling elements having a length shorter than the standard 18 millimeter aerosol-cooling elements in standard length aerosol-generating article. In particular, no lesser cooling or different smoke chemistry has been found in shorter aerosol-cooling elements made of polylactic acid.

Preferably, the aerosol-generating article is a smoking article that generates an aerosol. More preferably, the aerosol-generating article is a smoking article that generates a nicotine-containing aerosol.

Preferably, the predefined total length of the aerosol-generating article is 45 millimeter.

A length of the hollow tube comprised in the mouthpiece element may be adapted according to the length of the aerosol-cooling element such that the total length of the aerosol-generating article is kept at the predefined total length. Preferably, a length of the hollow tube and the length of the aerosol-cooling element are varied by a same amount, however, if the one element is made shorter, the other element is made longer. By this, any length reduction of the aerosol-cooling element is entirely compensated by the hollow tube. Preferably, the length of any other segment of the aerosol-generating article is kept unchanged. Preferably, the length of an aerosol-forming substrate, a support element and a filter segment article is kept unchanged. Preferably, the length of any other segment in the aerosol-generating article according to the present invention corresponds to the length of corresponding segments of standard aerosol-generating article. Such length may, for example, be 12 millimeter for the aerosol-forming substrate, 8 millimeter for the support element and 7 millimeter for the filter segment in a 45 millimeter aerosol-generating article.

The length of the aerosol-cooling element may be between 10 millimeter and 15 millimeter. Preferably, the length of the aerosol-cooling element is between 10 millimeter and 14 millimeter, for example 13 millimeter.

The length of the hollow tube may be between 3 millimeter and 8 millimeter. Preferably, the length of the hollow tube is 5 millimeter.

Preferably, the hollow tube is a cardboard tube.

The above mentioned lengths of hollow tubes, in particular of cardboard tubes, have shown to enable good manufacturing of the tubes as well as good handling of the tubes upon assembly of the mouthpiece element and of the aerosol-generating article.

Preferably, a wall thickness of the hollow tube is between 100 micrometer and 300 micrometer, for example 200 micrometer. When inserting an aerosol-generating article into an electronic heating device a consumer typically holds the article at its proximal end or pushes the article at its proximal end. Thus, the article is typically pushed at the hollow tube since the hollow tube is preferably the most proximal segment of the article. The above mentioned wall thicknesses have shown to suffice stability requirements for hollow tubes, in particular of cardboard tubes, when the aerosol-generating article is inserted into the electronic heating device. In particular, an aerosol-generating article having a proximal end comprising a cardboard tube of such wall thicknesses may reliably be inserted into a cavity of an electronic heating device, where a heating blade is to be pushed into the aerosol-forming substrate of the aerosol-generating article.

An 'aerosol-forming substrate' is a substrate capable of releasing volatile compounds that can form an aerosol. Volatile compounds may be released by heating or combusting the aerosol-forming substrate. As an alternative to heating or combustion, in some cases volatile compounds may be released by a chemical reaction or by a mechanical stimulus, such as ultrasound. An aerosol-forming substrate may be solid or liquid or comprise both solid and liquid components. An aerosol-forming substrate may be adsorbed, coated, impregnated or otherwise loaded onto a carrier or support. An aerosol-forming substrate may comprise plant-based material, for example a homogenised plant-based material. The plant-based material may comprise tobacco, for example homogenised tobacco material. The aerosol-forming substrate may comprise a tobacco-containing material containing volatile tobacco flavour compounds, which are released from the aerosol-forming substrate upon heating. The aerosol-forming substrate may alternatively comprise a non-tobacco-containing material. The aerosol-forming substrate may comprise at least one aerosol-former. The aerosol-forming substrate may comprise nicotine and other additives and ingredients, such as flavourants. Preferably, the aerosol-forming substrate is a tobacco sheet such as a cast leaf tobacco. Cast leaf tobacco is a form of reconstituted tobacco that is formed from a slurry including tobacco particles, fiber particles, aerosol formers, flavors, and binders. Tobacco particles may be of the form of a tobacco dust having a particle size preferably in the order between 30-80 micrometer or 100-250 micrometer, depending on the desired sheet thickness and casting gap. Fiber particles may include tobacco stem materials, stalks or other tobacco plant material, and other cellulose-based fibers, such as wood fibers having a low lignin content. Fiber particles may be selected based on the desire to produce a sufficient tensile strength for the cast leaf versus a low inclusion rate, for example, a rate between approximately 2 percent to 15 percent. Alternatively or additionally, fibers, such as vegetable fibers, may be used either with the above fibers or in the alternative, including hemp and bamboo.

Aerosol-forming substrates comprising gathered sheets of homogenised tobacco for use in aerosol-generating articles may be made by methods known in the art, for example the methods disclosed in the international patent application WO 2012/164009 A2.

Preferably, sheets of homogenised tobacco material for use in the aerosol-generating article are formed from a slurry comprising particulate tobacco, guar gum, cellulose fibres and glycerine by a casting process.

Aerosol formers may be added to the slurry that forms the cast leaf tobacco. Functionally, the aerosol former should be capable of vaporizing within the temperature range at which the cast leaf tobacco is intended to be used in the tobacco product, and facilitates conveying nicotine or flavour or both nicotine and flavour, in an aerosol when the aerosol former is heated above its vaporization temperature. The aerosol former is preferably chosen based on its ability to remain chemically stable and essentially stationary in the cast leaf tobacco at or around room temperature, but which is able to vaporize at a higher temperature, for example, between 40 degree to 450 degree Celsius.

As used herein, the term aerosol refers to a colloid comprising solid or liquid particles and a gaseous phase. An aerosol may be a solid aerosol consisting of solid particles and a gaseous phase or a liquid aerosol consisting of liquid particles and a gaseous phase. An aerosol may comprise both solid and liquid particles in a gaseous phase. As used herein both gas and vapour are considered to be gaseous.

The aerosol-generating substrate may have an aerosol former content of between 5 percent and 30 percent on a dry weight basis. In a preferred embodiment, the aerosol-generating substrate has an aerosol former content of approximately 20 percent on a dry weight basis.

Preferably, the aerosol-forming substrate comprises an aerosol former.

As used herein, the term 'aerosol former' is used to describe any suitable known compound or mixture of compounds that, in use, facilitates formation of an aerosol and that is substantially resistant to thermal degradation at the operating temperature of the aerosol-generating article. Preferably, the aerosol former is polar and is capable of functioning as a humectant, which can help maintain moisture within a desirable range in the cast leaf tobacco. Preferably, a humectant content in the cast leaf tobacco is in a range between 15 percent and 35 percent.

Preferably, the aerosol-forming substrate comprises an aerosol former.

Suitable aerosol-formers are known in the art and include, but are not limited to: polyols, glycol ethers, polyol ester, esters, fatty acids and monohydric alcohols, such as menthol and may comprise one or more of the following compounds: polyhydric alcohols, such as propylene glycol; glycerin, erythritol, 1,3-butylene glycol, tetraethylene glycol, triethylene glycol, triethyl citrate, propylene carbonate, ethyl laurate, triacetin, meso-erythritol, a diacetin mixture, a diethyl suberate, triethyl citrate, benzyl benzoate, benzyl phenyl acetate, ethyl vanillate, tributyrin, lauryl acetate, lauric acid, myristic acid, and propylene glycol.

One or more aerosol former may be combined to take advantage of one or more properties of the combined aerosol formers. For example, triacetin may be combined with glycerin and water to take advantage of the triacetin's ability to convey active components and the humectant properties of the glycerin.

The length of an aerosol-forming substrate may be 5 millimeter to 16 millimeter, preferably between 8 millimeter to 14 millimeter, for example 12 millimeter. An external diameter of an aerosol-forming substrate may be at least 5 millimeter and may be between 5 millimeter and 12 millimeter, for example between 5 millimeter and 10 millimeter or of between 6 millimeter and 8 millimeter. In a preferred embodiment, the aerosol-generating substrate has an external diameter of 7.2 millimeter plus-minus 10 percent.

Tobacco cast leaf is preferably crimped, gathered and/or folded to form a rod-shaped segment. The cast leaf material tends to be tacky and be plastically deformable. If pressure is exerted onto the cast leaf segment, the segment tends to irreversibly deviate from its intended, for example circular, shape.

The support element is located immediately downstream of the aerosol-forming substrate and abuts the aerosol-forming substrate. The support element locates the aerosol-forming substrate within the aerosol-forming article. In particular, the support element is configured to resist downstream movement of the aerosol-forming substrate during insertion of a heating element of an aerosol-generating device into the aerosol-forming substrate of the aerosol-generating article.

A support element may comprise a hollow tubular element. In a preferred embodiment, the support element comprises a hollow cellulose acetate tube. The support element preferably has an external diameter that is approximately equal to the external diameter of the aerosol-generating article.

The length of a support element may be 5 millimeter to 12 millimeter, for example 8 millimeter.

An external diameter of a support element may be between 5 millimeter and 12 millimeter, for example between 5 millimeter and 10 millimeter or between 6 millimeter and 8 millimeter. In a preferred embodiment, the support element has an external diameter of 7.2 millimeter plus or minus 10 percent.

The support element may be formed from any suitable material or combination of materials. For example, the support element may be formed from one or more materials selected from the group consisting of: cellulose acetate; cardboard; crimped paper, such as crimped heat resistant paper or crimped parchment paper; and polymeric materials, such as low density polyethylene (LDPE).

According to another aspect of the present invention, there is provided a method for manufacturing an aerosol-generating article. The method comprises the steps of:

- providing a semi-combined tobacco element by combining an aerosol-forming substrate, a support element and an aerosol-cooling element and wrapping the aerosol-forming substrate, the support element and the aerosol-cooling element with a wrapper;
- providing a semi-combined mouthpiece comprising a filter element;
- combining the semi-combined tobacco element and the semi-combined mouthpiece in an end-to-end relationship such that the aerosol-cooling element of the semi-combined tobacco element abuts the filter element of the semi-combined mouthpiece; and
- wrapping the semi-combined mouthpiece and parts of the semi-combined tobacco element with a tipping material. The method further comprises the steps of varying a length of the aerosol-cooling element and adapting a length of the semi-combined mouthpiece such as to keeping a total length of the aerosol-generating article at a predefined value. Thus a desired length of the aerosol-cooling element is selected and the length of the semi-combined mouthpiece is adapted accordingly in order to be able to keep the total length of the article at a predetermined value, preferably at a standard length.

The method steps of varying or selecting the length of the aerosol-cooling element and adapting the length of the semi-combined mouthpiece may comprise reducing the length of the aerosol-cooling element and extending the length of the semi-combined mouthpiece.

The method step of providing a semi-combined mouthpiece may comprise combining the filter element and a hollow tube and wrapping the filter element and the hollow tube with a wrapper.

Preferably, the step of adapting the length of the semi-combined mouthpiece comprises varying the length of the hollow tube. Preferably, the length of the hollow tube is extended by a same amount as the length of the aerosol-cooling element is reduced.

Advantages and further features of the method according to the invention are described relating to the aerosol-generating article according to the invention and will not be repeated.

In the manufacturing method for aerosol-generating articles according to the invention, the semi-combined mouthpiece may be a double-length mouthpiece with a double-length hollow tube arranged between two filter segments. The step of combining the semi-combined tobacco element and the semi-combined mouthpiece in an end-to-end relationship then comprises combining two semi-combined tobacco elements and the double-length mouthpiece such that the aerosol-cooling element of each of the semi-combined tobacco elements abuts the filter elements on each longitudinal side of the double-length mouthpiece. By wrapping the double-length mouthpiece and parts of each of the semi-combined tobacco elements with a tipping material a double-length aerosol-generating article is formed. The double-length aerosol-generating article may be cut into two single aerosol-generating articles preferably by cutting the double-length hollow tube.

A double-length component or article requires at least one cutting step for producing the single product. The double-length component or article has twice the length of a single product. The manufacture of double-length aerosol-generating articles may simplify a manufacturing process and enhance a manufacturing speed.

The invention is further described with regard to embodiments, which are illustrated by means of the following drawings, wherein.

Figure 1:
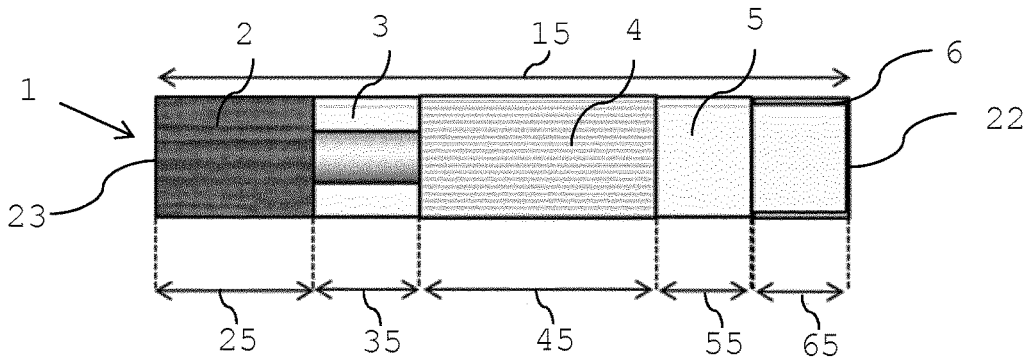
FIG. 1 is a schematic cross-sectional diagram of an aerosol-generating article.

FIG. 1 (as well as FIG. 4*c* see below) illustrates an aerosol-generating article 1 comprising five elements: an aerosol-forming substrate 2, a support element in the form of a hollow cellulose acetate tube 3, an aerosol-cooling element 4, a mouthpiece filter 5 and a cardboard tube 6. These five elements are arranged sequentially and in coaxial alignment and are assembled by a cigarette paper 7 and by a tipping paper 8 (shown in FIG. 4*c*) to form a rod. The rod has a mouth-end 22, which a user inserts into his or her mouth during use, and a distal end 23 located at the opposite end of the rod, opposite the mouth end 22. Elements located between the mouth-end 22 and the distal end 23 can be described as being upstream of the mouth-end 22 or, alternatively, downstream of the distal end 23. The cardboard tube 6 is located at the mouth-end 22 of the aerosol-generating article 1 and the aerosol-forming substrate 2 is located at the distal end 23 of the aerosol-generating article 1.

When assembled, the rod has a length 15 of 45 millimeter and has an outer diameter of about 7.2 millimeter.

The aerosol-forming substrate 2 is located upstream of the acetate tube 3 and extends to the distal end 23 of the rod. In one embodiment, the aerosol-forming substrate 2 comprises a bundle of crimped cast-leaf tobacco wrapped in a filter paper (not shown) to form a plug. The cast-leaf tobacco includes additives, including glycerine as an aerosol-forming additive. The length 25 of the aerosol-forming substrate is 12 millimeter.

The hollow acetate tube 3 is located immediately downstream of the aerosol-forming substrate 2 and abuts the aerosol-forming substrate 2. One function of the acetate tube 3 is to locate the aerosol-forming substrate 2 towards the distal end 23 of the rod so that it can be contacted with a heating element. The acetate tube 3 acts to prevent the aerosol-forming substrate 2 from being forced downstream the aerosol-generating article 1 towards the aerosol-cooling element 4, for example when a heating element is inserted into the aerosol-forming substrate 2. The acetate tube 3 also acts as a spacer element to space the aerosol-cooling element 4 from the aerosol-forming substrate 2. The length 35 of the acetate tube 3 is 8 mm.

The aerosol-cooling element 4 has a length 45 of 13 mm and an outer diameter of about 7.12 mm. Preferably, the aerosol-cooling element 4 is formed from a sheet of polylactic acid having a thickness of 50 mm plus or minus 2 mm. The sheet of polylactic acid has been crimped and gathered defining a plurality of channels that extend along the length of the aerosol-cooling element 4. The total surface area of the aerosol-cooling element may be between 300 $mm^2$ per mm length and 1000 $mm^2$ per mm length or about 10 $mm^2$ per mg weight and 100 $mm^2$ per mg weight of the aerosol-cooling element 4.

The length 45 of the aerosol-cooling element 4 is 5 mm shorter than conventional aerosol-cooling elements of aerosol-generating articles having a standard length of 45 mm. The length of conventional aerosol-cooling elements of such standard length aerosol-generating articles, in particular those aerosol-cooling elements made of polylactic acid sheets, is 18 mm.

The crimped and gathered sheet of polylactic acid may be wrapped within a filter paper (not shown) to form the aerosol-cooling element 4.

The mouthpiece filter 5 arranged downstream of the aerosol-cooling element 4 may be a conventional mouthpiece filter formed from cellulose acetate, and has a length 55 of 7 millimeter.

The cardboard tube 6 is the most downstream element of the aerosol-generating article 1 and has a length 65 of 5 millimeter. The cardboard tube makes up for the shorter aerosol-cooling element 4 such that the total length of the aerosol-generating article is 45 mm. The cardboard tube 6 also provides a recessed mouth-end 22 of the aerosol-generating article, simulating the use of conventional cigarettes having recessed mouth-ends.

The five elements identified above are assembled by being tightly wrapped within a paper 7. The paper 7 may be a conventional cigarette paper having standard properties. The interference between the paper 7 and each of the elements locates the elements and defines the rod of the aerosol-generating article 1.

An aerosol-generating article as illustrated in FIG. 1 is designed to engage with an aerosol-generating device (not shown) in order to be consumed. Such an aerosol-generating device includes means for heating the aerosol-forming substrate 2 to a sufficient temperature to form an aerosol. Typically, the aerosol-generating device may comprise a heating element that surrounds the aerosol-generating article adjacent to the aerosol-forming substrate 2, or a heating element that is inserted into the aerosol-forming substrate 2.

Once engaged with an aerosol-generating device, a user draws on the mouth-end 22 of the aerosol-generating article 1 and the aerosol-forming substrate 2 is heated to a temperature of about 375 degrees Celsius. At this temperature, volatile compounds are evolved from the aerosol-forming substrate 2. These compounds condense to form an aerosol, which is drawn through the rod towards the user's mouth.

Figure 2A:
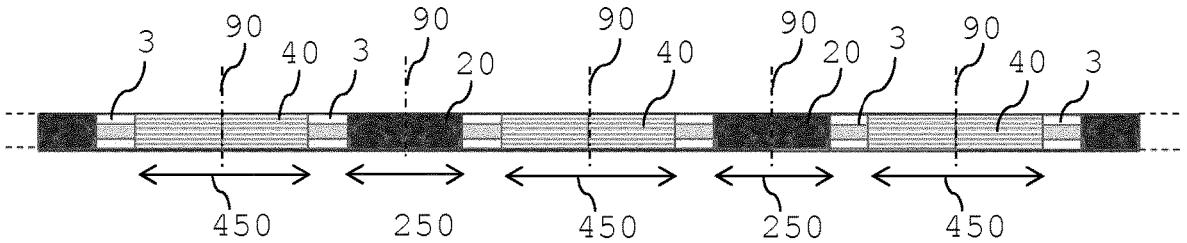
FIGS. 2 to 4 show a manufacturing process of an aerosol-generating article according to the invention.
Figure 2B:
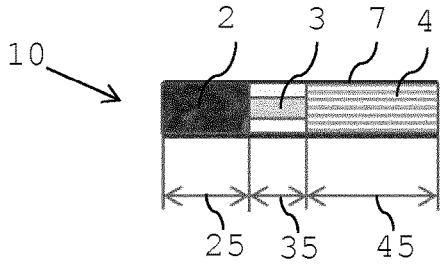
Figure 3A:
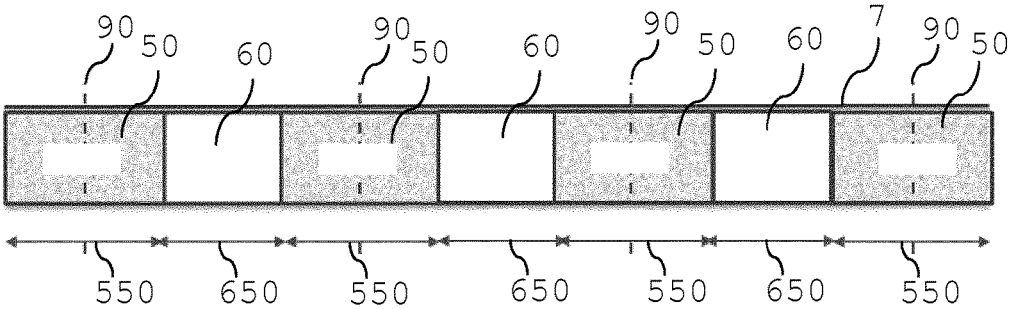
Figure 3B:
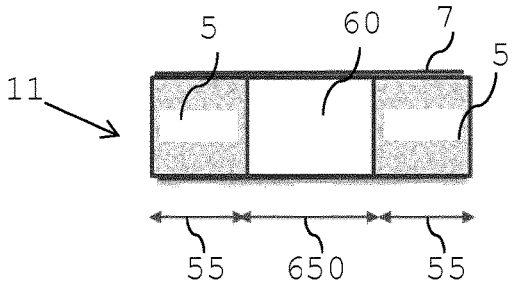
Figure 4A:
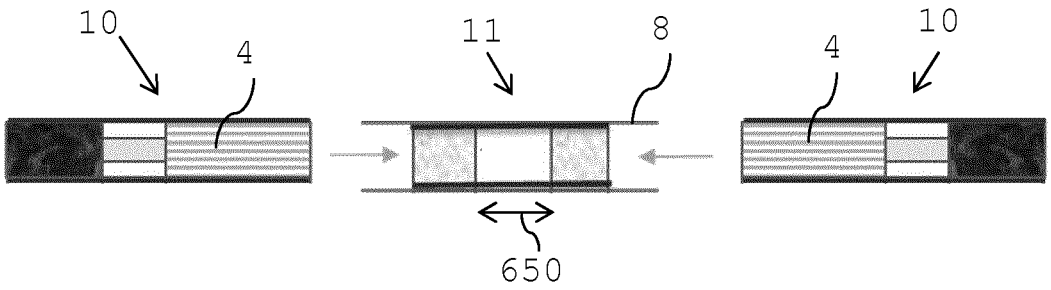
Figure 4B:
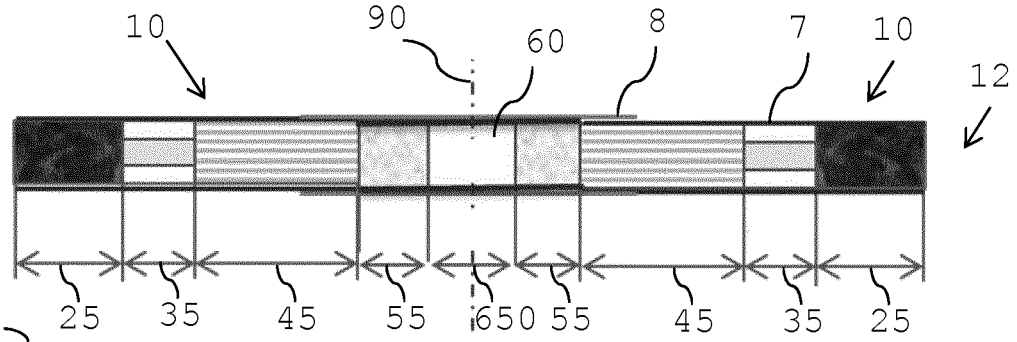
Figure 4C:
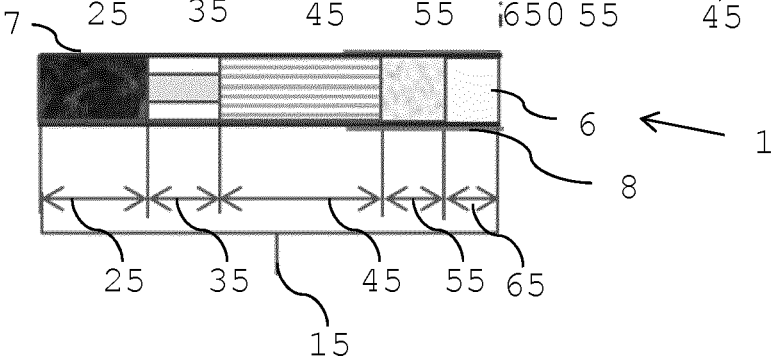

FIG. 2*a* and FIG. 2*b* show the process step for manufacturing a tobacco semi-finished product 10. FIG. 3*a* and FIG. 3*b* show the process step for manufacturing a semi-finished mouthpiece product 11. FIGS. 4*a*, 4*b* and 4*c* show the assembly process of the two semi-finished products of FIGS. 2*b* and 3*b* and the final manufacturing steps of the aerosol-generating article 1.

In the process steps for manufacturing tobacco semi-finished products 10, as shown in FIGS. 2*a* and 2*b*, a double-length aerosol-generating substrate 20 and a double-length aerosol-cooling element 40 with a hollow acetate tube 3 arranged in between the two double-length segments are provided in an end-to-end relationship forming a stream of segments. The stream of segments is wrapped with a wrapping material 7, for example cigarette paper. The so formed endless rod of segments is cut at cutting lines 90. Thereby, the double-length segments 20,40 having a length 250,450, which is double the length of the single corresponding elements 2,4 are cut in half. The two cut parts of the double-length segments 20,40 now correspond to single-length segments 2,4 of the final aerosol-generating article 1. By cutting the endless rod of segments wrapped semi-finished tobacco products 10 are manufactured.

In the process steps for manufacturing semi-finished mouthpiece products 11, as shown in FIGS. 3*a* and 3*b*, double-length filter segments 50 and double-length cardboard tubes are arranged in an end-to-end relationship forming a stream of mouthpiece segments. The stream of mouthpiece segments is wrapped with paper 7. The so formed endless rod of mouthpiece segments is cut at cutting lines 90. Thereby, the double-length filter segments 50, which have a length 550 that is double the length of the single corresponding filter 5, are cut in half. The two cut parts of the double-length filter segments 50 now correspond to single-length mouthpiece filter 5 of the final aerosol-generating article 1. By cutting the endless rod of segments wrapped semi-finished mouthpiece products 11 are manufactured.

In a next process step, as shown in FIG. 4*a*, two semi-finished tobacco products 10 are arranged in an end-to-end relationship, however, in opposite orientation such that the aerosol-cooling segments 4 of the two products are facing each other. In between the two semi-finished tobacco products 10 a semi-finished mouthpiece product 11 is arranged.

The semi-finished products 10,11 are assembled by wrapping a piece of tipping paper 8 around the semi-finished mouthpiece product 11 as well as around portions of the two semi-finished tobacco products 10. The portions of the semi-finished tobacco product 10 that are wrapped with tipping paper 8 preferably extend up to the aerosol-cooling elements 4. Thus, the three products 10,11 are combined with each other forming a double product 12, that is a double-length aerosol-generating article, as shown in FIG. 4*b*.

In an additional manufacturing process step, the double product 12 is cut in half by cutting the double-length cardboard tube 60 at cutting line 90. By this, the length 650 of the double-length cardboard tube 60, which corresponds to double the length 65 of the single cardboard tube 6 is divided in half. Two single and final aerosol-generating articles 1 as shown in FIG. 4*c* are manufactured.

The invention claimed is:

1. Aerosol-generating article for use in electronic heating devices, the article comprising a tobacco element and a mouthpiece element, the mouthpiece element arranged downstream from the tobacco element, the tobacco element comprising an aerosol-forming substrate, a support element arranged downstream of the aerosol-forming substrate and an aerosol-cooling element formed of a gathered sheet and arranged downstream of the support element;

the mouthpiece element comprising a filter segment and a hollow tube, wherein the hollow tube is a cardboard tube having a length between 3 millimeters and 8 millimeters and a wall thickness between 100 micrometers and 300 micrometers and arranged downstream of the filter segment and forming a most proximal segment of the aerosol-generating article;

wherein the aerosol-cooling element of the tobacco element has a length of at most 15 millimeters, and wherein a length of the mouthpiece element is adapted according to the length of the aerosol-cooling element such that a total length of the aerosol-generating article is kept at a predefined total length of 45 millimeters.

2. Aerosol-generating article according to claim 1, wherein the length of the aerosol-cooling element is between 10 millimeters and 15 millimeters.

3. Aerosol-generating article according to claim 1, wherein the length of the hollow tube is 5 millimeters.

4. Aerosol-generating article according to claim 1, wherein a wall thickness of the hollow tube is 200 micrometers.

5. Aerosol-generating article according to claim 1, wherein the length of the mouthpiece element is between 8 millimeters and 25 millimeters.

6. Aerosol-generating article according to claim 1, wherein the length of the aerosol-forming substrate is between 5 millimeters and 16 millimeters.

7. Aerosol-generating article according to claim 1, wherein the length of the support element is between 5 millimeters and 12 millimeters.

8. Aerosol-generating article according to claim 1, wherein the aerosol-cooling element is made of polylactic acid sheet.

9. Aerosol-generating article according to claim 1, wherein the aerosol-cooling element is made of a crimped and gathered sheet.

10. Aerosol-generating article according to claim 1, wherein the aerosol-cooling element is made of a sheet having a thickness between 10 micrometers and 250 micrometers.

11. Aerosol-generating article according to claim 1, wherein the aerosol-cooling element reduces phenolic compounds of an aerosol from the aerosol-forming substrate.

12. Method for manufacturing aerosol-generating articles the method comprising the steps of:

providing a semi-combined tobacco element by combining an aerosol-forming substrate, a support element and an aerosol-cooling element formed of a gathered sheet and arranged downstream of the support element and wrapping the aerosol-forming substrate, the support element and the aerosol-cooling element with a wrapper;

providing a semi-combined mouthpiece comprising a filter element and a hollow tube, wherein the hollow tube is a cardboard tube having a length between 3 millimeters and 8 millimeters and a wall thickness between 100 micrometers and 300 micrometers;

combining the semi-combined tobacco element and the semi-combined mouthpiece in an end-to-end relationship such that the aerosol-cooling element of the semi-combined tobacco element abuts the filter element of the semi-combined mouthpiece wherein the filter element forming a most proximal segment of the aerosol-generating article;

wrapping the semi-combined mouthpiece and parts of the semi-combined tobacco element with a tipping material; and selecting a length of the aerosol-cooling element of at most 15 millimeters and adapting a length of the semi-combined mouthpiece such as to keeping a total length of the aerosol-generating article at a predefined value of 45 millimeters.

13. Method according to claim 12, wherein the steps of selecting the length of the aerosol-cooling element and adapting the length of the semi-combined mouthpiece comprise reducing the length of the aerosol-cooling element and extending the length of the semi-combined mouthpiece.

14. Method according to claim 12, wherein the step of providing a semi-combined mouthpiece comprises combining the filter element and a hollow tube and wrapping the filter element and the hollow tube with a wrapper.

15. Method according to claim 14, wherein the semi-combined mouthpiece is a double-length mouthpiece with a double-length hollow tube arranged between two filter segments, and the step of combining the semi-combined tobacco element and the semi-combined mouthpiece in an end-to-end relationship comprises combining two semi-combined tobacco elements and the double-length mouthpiece such that the aerosol-cooling element of each of the semi-combined tobacco elements abuts the filter elements on each longitudinal side of the double-length mouthpiece;

wrapping the double-length mouthpiece and parts of each of the semi-combined tobacco elements with a tipping material thus forming a double-length aerosol-generating article;

cutting the double-length aerosol-generating article by cutting the double-length hollow tube.

16. Method according to claim 14, therein extending the length of the hollow tube by a same amount as reducing the length of the aerosol-cooling element.

* * * * *